US005506043A

United States Patent [19]

Lilani

[11] Patent Number: 5,506,043

[45] Date of Patent: Apr. 9, 1996

[54] THERMAL PROTECTIVE FABRIC AND CORE-SPUN HEAT RESISTANT YARN FOR MAKING THE SAME, SAID YARNS CONSISTING ESSENTIALLY OF A FIBERGLASS CORE AND A COVER OF MODACRYLIC FIBERS AND AT LEAST ONE OTHER FLAME RETARDANT FIBER

[75] Inventor: Harish N. Lilani, Plymouth Meeting, Pa.

[73] Assignee: Norfab Corporation, Norristown, Pa.

[21] Appl. No.: 275,859

[22] Filed: Jun. 2, 1993

Related U.S. Application Data

[63] Continuation of Ser. No. 846,745, Mar. 6, 1992, abandoned, which is a continuation of Ser. No. 396,378, Aug. 18, 1989, abandoned.

[51] Int. Cl.[6] ..... D02G 3/02; D02G 3/06; D03D 3/00; B27N 9/00

[52] U.S. Cl. ..... 428/229; 57/210; 57/224; 57/229; 428/377; 428/902; 428/920

[58] Field of Search ..... 57/229, 224, 210; 428/373, 390, 377, 920, 375, 921, 285, 902, 229

[56] References Cited

U.S. PATENT DOCUMENTS

| | | | |
|---|---|---|---|
| 2,165,772 | 7/1939 | Walsh et al. | 28/4 |
| 2,179,087 | 11/1939 | Gibbons | 57/144 |
| 2,230,271 | 2/1941 | Simpson | 19/146 |
| 3,292,991 | 12/1966 | Crawley | 8/115.7 |
| 3,392,079 | 7/1968 | Fekete | 161/59 |
| 3,395,527 | 8/1968 | Longley | 57/140 |
| 3,664,905 | 5/1972 | Schuster | 161/59 |
| 3,729,920 | 5/1973 | Sayers et al. | 57/229 |
| 3,751,897 | 8/1973 | Bailey | 57/144 |
| 3,811,262 | 5/1974 | Clarkson | 57/140 |
| 3,913,309 | 10/1975 | Chiarotto | 57/144 |
| 4,015,038 | 3/1977 | Romanski et al. | 428/255 |
| 4,160,051 | 7/1979 | Benisek | 428/921 |
| 4,162,190 | 7/1979 | Ashworth | 162/359 |
| 4,255,817 | 3/1981 | Heim | 2/2 |
| 4,284,682 | 8/1981 | Tschirch et al. | 428/263 |
| 4,302,496 | 11/1981 | Donovan | 428/196 |
| 4,331,729 | 5/1982 | Weber | 428/252 |
| 4,381,639 | 5/1983 | Kress | 57/229 |
| 4,500,593 | 2/1985 | Weber | 428/377 |
| 4,529,643 | 7/1985 | Lundstrom | 428/234 |
| 4,623,571 | 11/1986 | Yamamoto et al. | 428/920 |
| 4,670,327 | 6/1987 | Weber | 428/257 |
| 4,743,495 | 5/1988 | Lilani et al. | 428/234 |
| 4,863,797 | 9/1989 | Ichibori et al. | 428/373 |
| 4,863,799 | 9/1989 | Mininni et al. | 428/373 |
| 4,865,906 | 9/1989 | Smith, Jr. | 428/373 |
| 4,868,041 | 9/1989 | Yamagishi et al. | 428/377 |
| 4,921,756 | 5/1990 | Tolbert et al. | 428/377 |
| 4,927,698 | 5/1990 | Jaco et al. | 428/377 |
| 4,958,485 | 9/1990 | Montgomery et al. | 428/377 |

OTHER PUBLICATIONS

Hawley's Condensed Chemical Dictionary, Eleventh Edition, face page and pp. 19 and 790.

*Primary Examiner*—James D. Withers
*Attorney, Agent, or Firm*—Volpe and Koenig

[57] ABSTRACT

A heat resistant woven fabric with an optional aluminized backing is disclosed. The fabric is particularly suited for heat resistant garments intended to resist radiant heat and minor molten metal splashes. The fabric comprises of core-spun yarns having a core of flame and high heat resistant filament fiberglass yarn covered by a layer of flame retardant modacrylic fibers, with or without blending with other fibers.

6 Claims, 4 Drawing Sheets

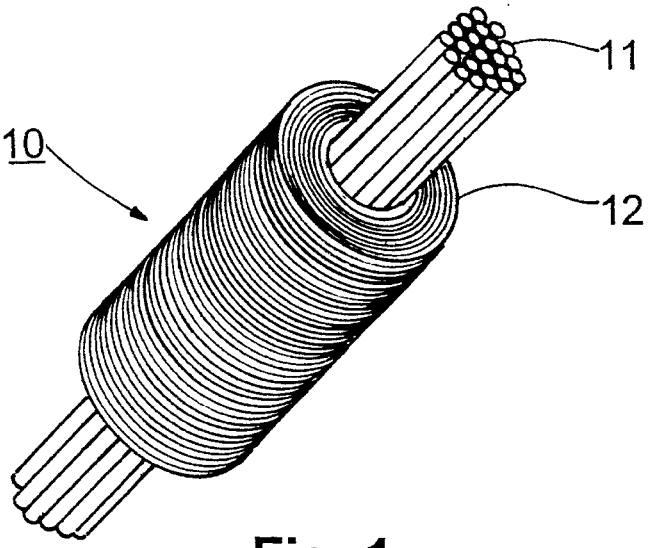
Fig. 1
Fig. 2
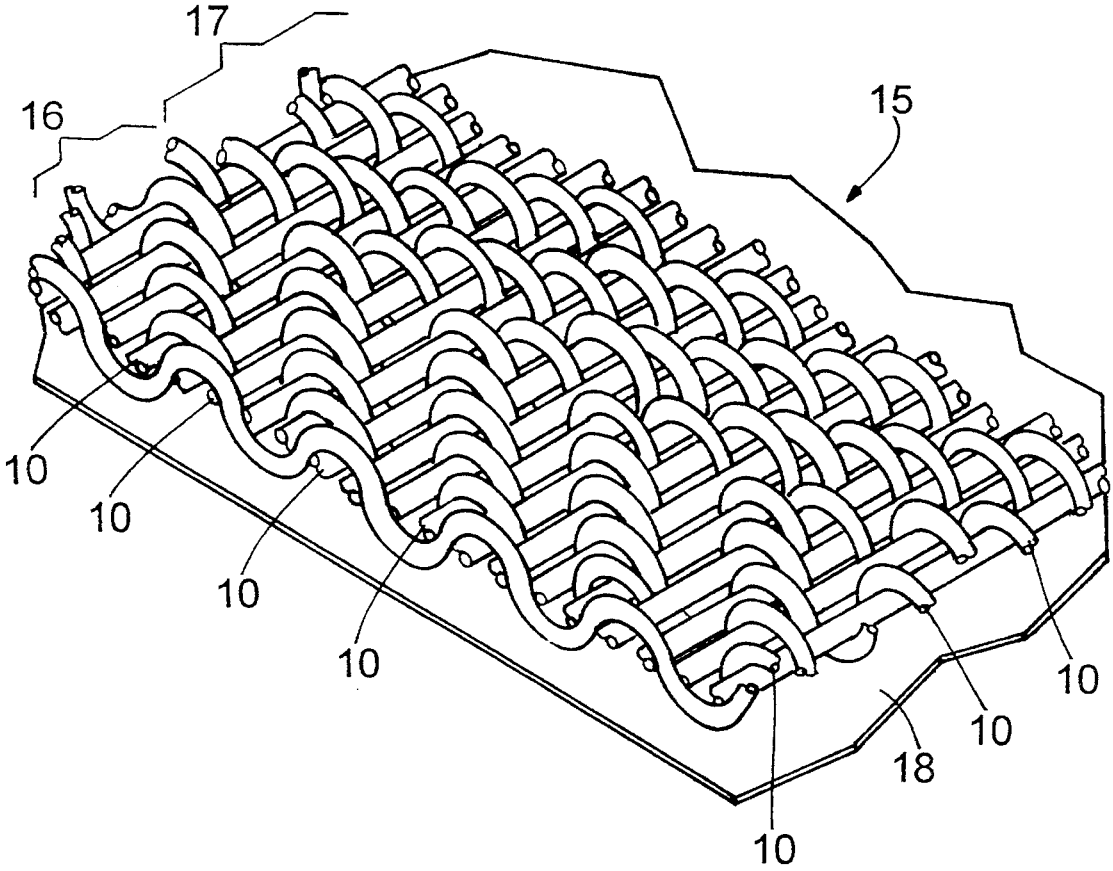

THERMAL PROTECTIVE FABRIC AND CORE-SPUN HEAT RESISTANT YARN FOR MAKING THE SAME, SAID YARNS CONSISTING ESSENTIALLY OF A FIBERGLASS CORE AND A COVER OF MODACRYLIC FIBERS AND AT LEAST ONE OTHER FLAME RETARDANT FIBER

This application is a continuation of application Ser. No. 07/486,745, filed Mar. 6, 1992, now abandoned, which is a continuation of application Ser. No. 07/396,378, filed August 1989, now abandoned.

BACKGROUND OF THE INVENTION

FIELD OF THE INVENTION

This invention generally relates to heat resistant fabrics and yarn for making the same. This invention relates more specifically to a heat resistent cost effective yarn and fabrics made therefrom which are suitable for use in molten metal splash type applications.

It has heretofore been common practice to make heat resistant fabrics from yarns of asbestos fibers. The high heat resistant asbestos fiber offered one of the highest level of resistance to molten metal splashes and was used extensively for minor as well as major molten metal splash applications. More recently, the use of asbestos fibers has been considered hazardous to the user as well as other persons exposed to the fibers.

The fabric and yarn of the present invention do not utilize asbestos fibers but do find utility as substitutes for asbestos yarn and fabric.

Other inventors have attempted to develop asbestos substitute fabrics suitable for minor molten metal splash applications. These prior attempts yielded fabrics which satisfied the application but did not offer the same thermal protection or the cost effectiveness of the present invention.

Although efforts to examine the hazard levels of various molten metal splash applications and to quantify the required fabric performance levels for those applications have advanced development of fabrics for the specified level of performance with respect to minor molten metal splash resistance, there was still a need for a cost effective fabric in the minor molten metal splash application. Presently, the most common fabrics are constructed using ring-spun yarns of Permanently Flame Retardant (PFR) Rayon (Cellulosic) fibers. Additionally, there is some use of fabrics which are comprised of yarns having an aramid wrapping which is spun about a core, however, they are quite expensive for this application.

As can be seen from the above, the art desires a yarn and fabrics which are usable in minor molten metal splash type applications and direct radiant heat at a cost effective level.

The fabric of the invention employs known techniques of manufacturing core spun yarn with a novel fiber mix and distribution of fibers as a means to optimize cost and performance with respect to minor molten metal splash resistance.

It is the principal object of the invention to provide a lightweight fabric, for protecting personnel and equipment, which is cost effective, resistant to high temperatures, thermal shocks and suitable for application in minor molten metal splashes.

Other objects and advantageous features of the invention will be apparent from the descriptions and claims.

SUMMARY OF THE INVENTION

In accordance with the invention, a suitable fabric is provided for protective garments and clothing which are designed mainly to provide protection against radiant heat exposure and minor molten metal splashes. The yarns for the construction of this fabric are made using core-spun yarns having a high temperature and flame resistant central core component of filament fiberglass yarn wrapped with a covering consisting of flame retardant modacrylic fibers. Subsequently, the core-spun yarns are converted into a suitable fabric. In the preferred embodiment, the woven fabric is laminated with a protective metallic foil/film using standard laminating techniques.

BRIEF DESCRIPTION OF THE DRAWINGS

The nature and characteristic features of the invention will be more readily understood from the following description taken in connection with the accompanying drawings forming part hereof in which:

FIG. 1 is an enlarged view in elevation of a yarn in accordance with the invention, and FIG. 2 is an enlarged view in perspective of a suitable fabric made from the yarn of FIG. 1.

Like numerals refer to like elements throughout the several view.

DESCRIPTION OF THE PREFERRED EMBODIMENTS

Figure 4:
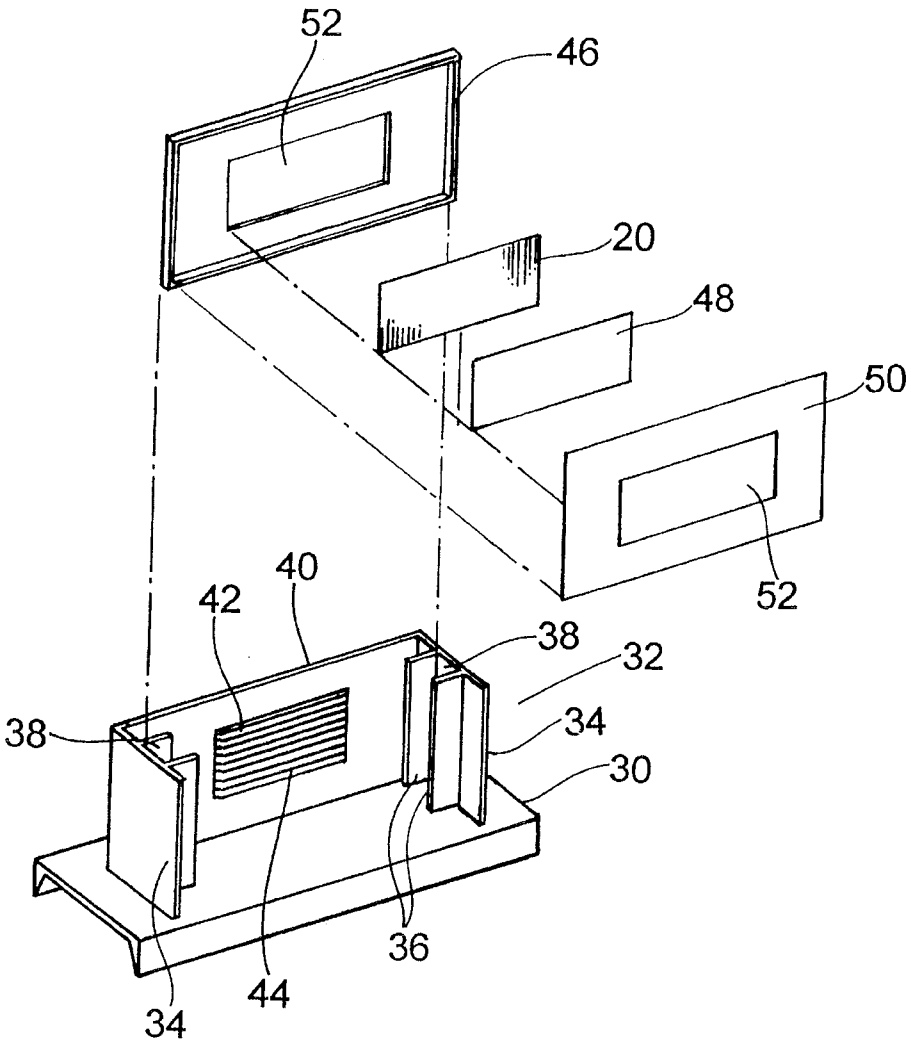
FIG. 4 depicts a test apparatus for radiant heat.

Referring now more particularly to FIG. 1 of the drawings, a core-spun yarn 10 is there illustrated which includes a core 11 of multiple filaments and a covering 12 of fibers enclosing the core 11.

The core 11 is preferably of flame and high heat resistant filament fiberglass fibers. One suitable fiberglass core material is available under the trade name Fiberglas from Owens/Corning Fiberglass Company, Toledo, Ohio and another suitable fiberglass material is available from PPG Company, Pittsburgh, Pa.

The core 11 is of fragile fiberglass material with low abrasion resistance and high temperature resistance, softening above 1,300° F. and melting above 2,000° F., with a thermal shock resistance to molten steel on the order of 2850° F.

While the size and the weight of core 11 may be varied, one suitable core is ECDE 150 1/0—1 Z—33 tex Fiberglas yarn from Owens-Corning. In this case, core 11 is a continuous filament yarn containing approximately 408 single filaments with a strand count of 150 and a nominal 0.00025 filament diameter with one Z turn per inch.

The cover 12 is preferably of flame retardant modacrylic fibers, each fiber being individually wrapped around core 11 to form the cylindrical spiral covering 12. One suitable material is available under the trade name Teklan from Courtaulds plc Coventry, Warwickshire England. By way of comparing the covering to the core, it should be noted that Teklan fiber has a softening point of about 374° F. Thus the core softening temperature is about 3.5 times that of covering 12.

Other such suitable fibers for cover 12 are available under the following trademarks, Dynel from Union Carbide Company, SEF fiber from Monsanto Company and Verel from Eastman Company. The covering 12 can also be of a blend of flame retardant modacrylic fibers or of flame retardant modacrylic fibers blended with other fibers. Suitable blends may consists of flame retardant modacrylic and aramid fibers and/or phenolic fibers and/or flame retardant cellulosic fibers and/or polybenzimidazole and/or partially oxidized or fully oxidized PAN fibers.

The size and weight of the covering 12 may be varied in accordance with required yarn weight, however, the core to cover ratio should be about 2 to 3. The covering 12 is applied to the core 11 by individually wrapping the fibers in a cylindrical spiral around the core 11 so that core 11 is completely covered. In the preferred embodiment, the core spun yarn is produced on the Dref Core Spinning Systems available from the Feher Co. of Linz, Austria.

As noted, the proportions of core to covering may be varied as desired. However, in the preferred embodiment, the ratio of filament core to modacrylic fibers is 2 to 3 by weight.

Although the covering 12 is not as resistant to high temperature as the core 11, it does provide a cushion around core 11 to compensate for its fragility and lack of abrasion resistance. Thus, a suitable yarn which is resistant to high temperatures and to thermal shocks is provided for fabrication into a textile fabric.

Referring now to FIG. 2 one suitable textile fabric 15 is illustrated. The textile fabric 15 as shown is a herringbone weave with both warp and filling threads of the yarns 10 heretofore described. The warp threads and filling threads may be of single or plied construction. The weave may be of any desired pattern providing a stable textile fabric. As illustrated, the weave comprises unitary bands 16 and 17 of two up, two down herringbone twill, each of a width of approximately one half inch. The weight of the textile fabric may be varied between 4 to 24 oz. per square yard with the preferred fabrics weighing approximately 14 oz. per square yard. The fabric 15 can be made into protective clothing and maintenance fabrics. The textile fabric 15 has high heat and abrasion resistance, and resistance to thermal shock attendant upon splashing of molten metal.

As also shown in FIG. 2, a metallic lamination 18, preferably of aluminum foil or film, can be provided by vacuum application or by passing the fabric and the film between pressure applying rolls after an adhesive has been applied to the fabric, or in any other desired manner, including spray coating, to increase heat reflection and further enhance the qualities of the fabric.

The cost effectiveness of the present invention may be seen from the following.

Example 1

If one assumes a metallized or aluminized PFR rayon fabric with the weight of 19 oz. per square yard, you will have approximately 17 oz. of substrate fabric with a requirement for about 1.055 pounds of the PFR rayon staple fiber per square yard of substrate fabric. The yarn is a ring spun yarn and the substrate fabric is woven in a herringbone weave. Based on the foregoing, the cost factor for the PFR rayon fabric can be calculated. PFR rayon fiber is commercially available at a cost factor of approximately 3.5 per pound. Since the substrate fabric is comprised entirely of PFR rayon, the cost factor for the staple fibers raw material in one square yard of the PFR rayon substrate fabric is 1.005×3.5 or approximately 3.7.

Example 2

If one now assumes an aluminized or metallized 16 oz. per square yard fabric having a substrates fabric woven from core spun yarns utilizing a fiberglass core and an aramid cover fiber, you will have approximately 14 oz. of substrate fabric. A suitable fiberglass filament, 33 tex yarn is commercially available for a cost factor of approximately 1.75 per pound and aramid cover fiber is available in a cost factor range per pound of about 7.6 to 10.60 or an average of 9.1. Kevlar and Nomex are the trade names for two suitable aramid fibers. Utilizing the preferred ratio of the present invention of 40% central core weight and 60% covering weight, we can calculate the cost factor for the fiberglass core—aramid cover core spun yarn. Using the foregoing fiber contribution for the core spun yarn and the same construction as the substrate fabric of Example 1, the raw material cost factor is $(1.75\times0.4)+(9.1\times0.6)\times{}^{14}/_{16}$ or 4.84.

Example 3

Turning to the present invention, if one assumes a 16 oz. square yard aluminized fabric having a substrates fabric of 14 oz. per square yard maybe produced in the same manner and with the same commercially available fiberglass filament as Example 2 but with a covering of modacrylic fiber, substrate cost savings are realized. Modacrylic fiber is available for a cost factor of approximately 1.85 per pound. Based on the cost factors, the raw materials cost for fabric of the present invention in the same construction as Examples 1 and 2 is $(1.75\times0.4)+(1.85\times0.6)\times{}^{14}/_{16}$ or approximately 1.58.

Upon exposure to temperatures in the range of 400° F. through 700° F., the fiberglass core aramid fabric, Example 2, will have performance characteristics which are equivalent to those of the invention, Example 3; however, the PFR rayon fabric, Example 1, will not equal those performances. The rayon fabric will exhibit significant thermal shrinkage while the fabric of the present invention will remain virtually unchanged. The rayon fabric will exhibit high weight loss which results in poor thermal stability. By way of distinction, the fabric of the present invention exhibits very low weight loss and high thermal stability.

Figure 3:
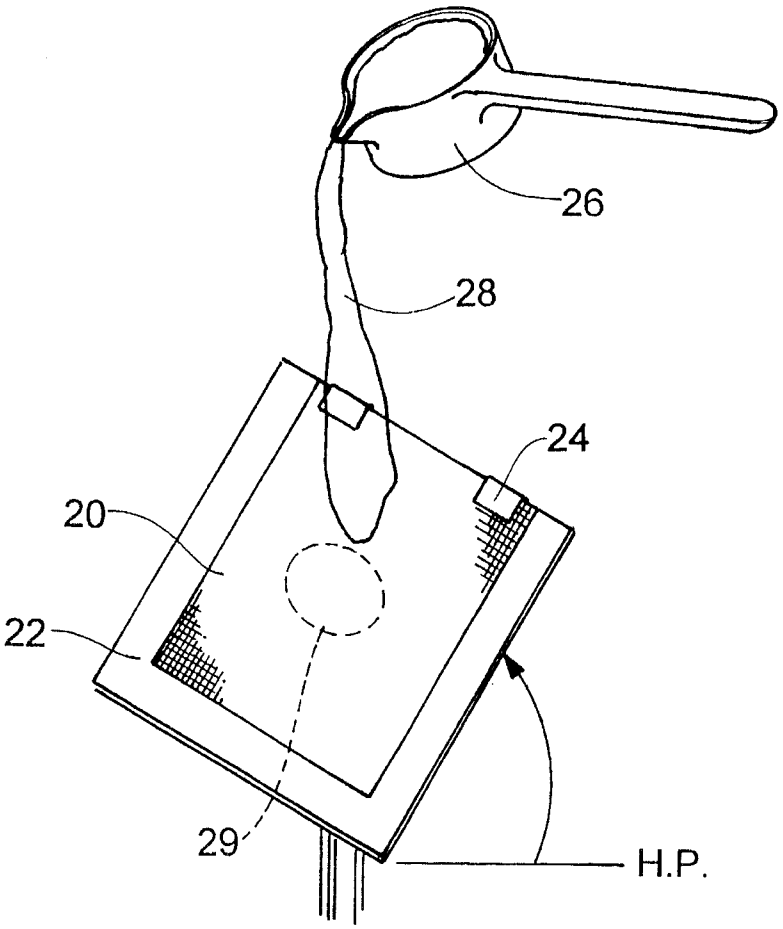
FIG. 3 depicts a test apparatus for molten metal splash.

The experimental method for testing with respect to molten metal splash is illustrated in FIG. 3. The fabric 20 is mounted on transite board 22 and held in place with clips 24 along the upper edge. The fabric is mounted at an angle alpha which is 70° from the horizontal plane H.P. The ladle 26 contains the hot molten metal 28 which is poured from a height of about 12 inches from the fabric. While the ladle 26 has been illustrated with a handle affixed thereto, it is most common to have the ladle mounted in a fixed manner so as to control the distance between the ladle and the fabric.

To summarize, the molten metal splash test, two pounds of iron at a temperature of approximately 2750° F. are poured onto fabric samples which are disposed at an angle of about 70° from the horizontal. The distance between the source of the molten metal and the fabric sample is approximately 12 inches. The preheated ladle is filled with molten iron from the furnace. The metal weight is determined on a spring balance and is maintained at about two pounds. The filled ladle is transferred to a holding or pouring ladle and poured onto the fabric. A delay of fifteen seconds between the furnace pour and the ladle pour is used to ensure the constant temperature of the metal. The results of the tests are assessed by visual examination and heat transfer through the sample.

Still with reference to FIG. 4, heat transfer through the metallized fabric may be sensed by placing a copper disk calorimeter 29 behind the sample. Upon molten metal impact on the surface of the aluminized fabric, the heat energy flows rapidly through the structure of the fabric. The rate of the total heat flow through the fabric depends on various fabric parameters such as the aluminized surface smoothness, type of weave, fabric structure, yarn structure, fiber distribution, thermal resistance of fiber i.e. flame resistance, transition temperature, softening, melting, charring, etc.

In the fabric of Example 3, the above referenced parameters were selected to optimize the fiber, yarn structure and performance levels while minimizing the cost factor of the raw materials.

As noted above, the heat energy upon impact starts to char the modacrylic fiber in the fabric of the invention, at the same time, the temperature rise in the charred modacrylic fibers do not allow a spontaneous combustion in the fabric since the modacrylic fibers used are flame retardant. The flow of heat through the fabric is further restricted by the central core of filament fiberglass which also does not support flame. Subsequently, in about 10 seconds after the impact of molten metal, the charred modacrylic fibers offer additional thermal protection that shows as a slow and steady decrease in temperature rise until 30 seconds after impact when the maximum temperature rise of 41° F. is reached.

By way of comparison, the fabric of Example 1 shows a much higher temperature rise due to the charring of PFR rayon fibers. The flow of heat through the Example 1 fabric is not restricted by a central high heat and flame resistant core. The temperature rise in the first 30 seconds after the impact of molten metal is much higher in the Example 1 fabric. In fact, it reaches the maximum of 93° F.

Figure 5:
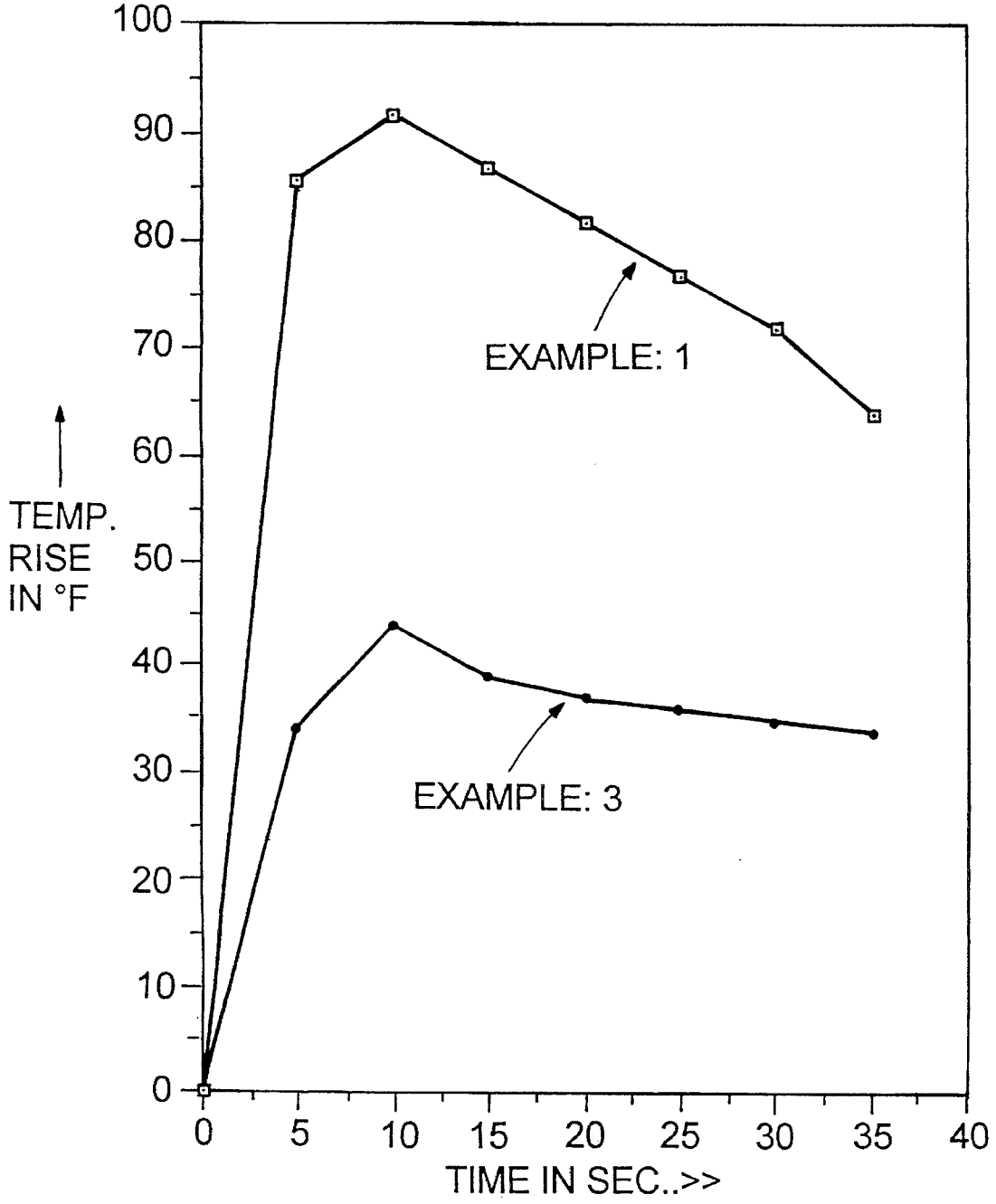
FIG. 5 is a graph depicting temperature increase through the fabric vs. time.
Figure 6:
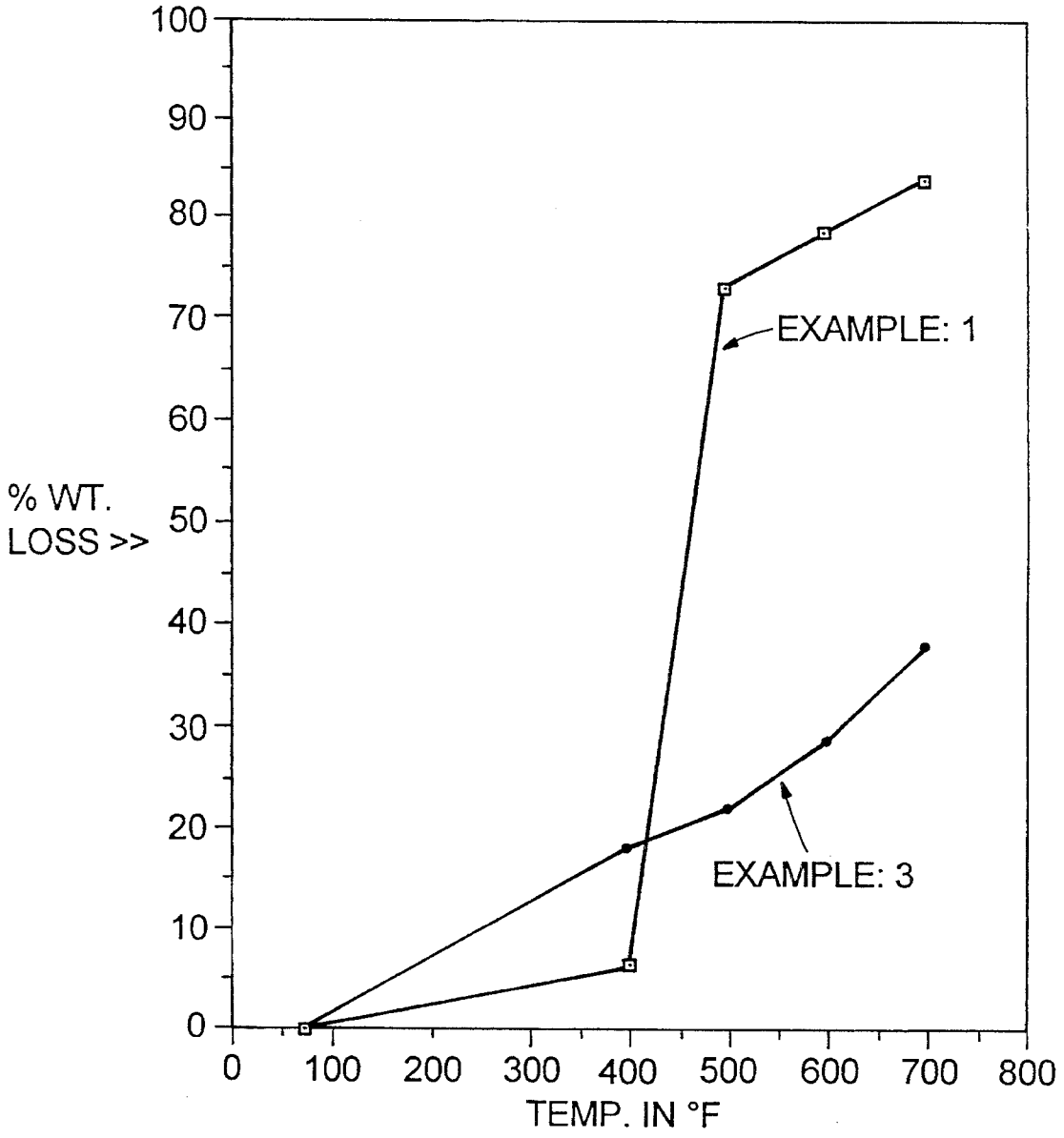
FIG. 6 is a graph depicting weight loss vs. temperature.

The above data is graphically depicted in FIG. 5.

In the molten metal splash test, fabrics incorporating yarns according to the present invention out perform fabrics of Example 1 and were equivalent to the performance of Example 2.

With reference to FIG. 4, there is illustrated an apparatus for measuring the heat reflectivity of metallized fabrics in accordance with the principles of military heat reflection test number MIL-C-87076. The test apparatus is comprised of a base 30 on which sample holder 32 is mounted. Sample holder 32 is comprised of two side walls 34 which are mirror images of each other. Each side wall 34 has two vertically disposed slats 36 which define a channel 38. Each of the side walls 34 abuts the front wall 40. The front wall 40 has an aperture 42 in about the center thereof. Quartz lamps 44 are mounted on the outside of front wall 40. The channels 38 are positioned on side walls 34 so that the fabric sample will be positioned at approximately one inch from the quartz lights. The fabric sample 20 is secured in a sample holder 46. The sample is placed directly into sample holder 46 with a piece of blotting paper 48 positioned directly behind the sample 20. Immediately behind the blotting paper 48 is a holder plate 50. Both the sample holder 46 and the holder plate 50 have an aperture 52 in about the center thereof. Apertures 52 are positioned so as to be on line with the aperture 42 in the front wall 40.

In testing, fabric sample 20 is exposed to a radiant heat source which consists of five infrared quartz lamps. The average temperature of the lamps is kept at 2730° F. This temperature is approximately the same temperature as would be found in a steel industry furnace. The sample is placed at the distance of one inch from the radiant heat source. After thirty seconds of exposure, the sample is removed from the sample holder and the degradation of the fabric is assessed by examining the amount of darkening to the blotter paper which was positioned behind the sample.

For high radiant heat exposures of 1500° to 3000 ° F., the metallized fabrics incorporating yarns according to the present invention performed equally with the more expensive core spun aramid yarn of Example 2. Fabrics of the present invention out perform fabrics according to Example 1.

Since many applications do not require the ability to withstand temperatures above 700° F., the use of the core spun aramid yarns represents an excessive cost factor in exchange for unnecessary performance. While the PFR rayon yarns do find applications at these temperatures at a more advantageous cost factor than the core spun aramid yarns, they still represent a more costly alternative to the yarn and fabrics in the present invention.

By way of further comparison of the present invention to the PFR rayon product, reference is made to FIG. 5. If dry samples of the fabrics according to Examples 1 and 3 are exposed to dry hot air temperatures up to 700°, the base fabric of Example 3 will retain substantially more of its fabric weight. The percentage weight loss relates directly to the mass of the base fabric which will be retained and, therefore, available for protection. Such testing may be conducted using thermal gravimetric analysis which will be known to those skilled in the art. With reference to FIG. 5, samples of each of the base fabrics were exposed to temperatures of 400°, 500°, 600° and 700° F. The exposure was for two hours. The weight loss at each temperature was recorded in as percentage weight loss on FIG. 5. As can be seen with reference to FIG. 5, Example 1 exhibited better weight retention than Example 3 at the 400° range. However, at the 500° point, Example 1 exhibited a substantial weight loss when compared to Example 3. In fact, Example 1 exhibited a weight loss between 400° and 500° F. of approximately 60%. At 600° F., Example 3 still retained more than 70% of its weight. By comparison, Example 1 had lost more than 70% of its weight. At 700° F., Example 3 had retained more than 60% of its weight and Example 1 had lost more than 80% of its weight. By way of summary, Example 1 lost approximately 7% at 400° F., 75% at 500° F., 78% at 600° F. and 83% at 700° F. By way of comparison, Example 3, at the same temperatures, had respective weight losses of 18% 20% 28% and 35%. By way of comparing an asbestos base fabric to that of Example 3, asbestos can be expected, depending upon its weight and fiber composition, to exhibit weight losses of between 10 and 30%. Accordingly, Example 3 compares favorably with asbestos at the upper ranges. As demonstrated by FIG. 5, the present invention has substantial benefits over the prior art fabrics in temperature ranges between 400° and 700° F.

As can be seen from the above, the present invention in exposures such as radiant heat, conductive heat, convected heat, flame resistant and minor molten metal splash resistance will perform equally with the fiberglass core aramid fabric and will surpass the PFR rayon fabric. Since the performance characteristics in a given application are essential, a comparison of cost as related to performance becomes important in the evaluation of fabrics.

In the same temperature range of application, the present invention will outperform the PFR rayon material and will have a favorable cost ratio. The present invention is more than two (2) times as cost effective as the PFR rayon (cost factor of 1.58 vs. cost factor of 3.70).

Although the core spun aramid material will withstand higher temperatures, the comparable performance in the same temperature range of application does not justify the additional cost factor. The present invention in the same temperature range of application around 700° F. is more than three (3) times as cost effective as the core spun aramid (cost factor of 1.58 vs. cost factor of 4.84).

As can be seen from the above, the present invention provides an excellent cost effective material for application above 400° F. and up to about: 700° F.

What is claimed is:

1. A high temperature and thermal shock resistant textile yarn consisting essentially of a continuous filament fiberglass central core enclosed within a fiber cover consisting of high temperature resistant and flame retardant modacrylic fibers with at least one fiber selected from the group consisting of aramid fibers, phenolic fibers, flame retardant cellulosic fibers, polybenzimidazole fibers, partially oxidized PAN fibers and fully oxidized PAN fibers individually wrapped about the core, whereby the resultant yarn has a core to cover ratio of about 2 to 3 by weight.

2. The yarn of claim 1 wherein the fibers of the cover form a cylindrical spiral around the central core.

3. A high temperature, thermal shock resistant textile fabric consisting essentially of yarns having a continuous filament fiberglass central core that is substantially axially oriented and a fiber cover consisting of high temperature and flame retardant modacrylic fibers with at least one fiber selected from the group consisting of aramid fibers, phenolic fibers, flame retardant cellulosic fibers, polybenzimidazole fibers, partially oxidized PAN fibers and fully oxidized PAN fibers individually wrapped about the core, so that the yam has a core to cover ratio of about 2 to 3 by weight and the fabric upon exposure to dry heat at temperatures up to 700° F. has a percentage weight loss of no greater than about 35% and a splash resistance to two pounds of molten iron at a temperature of approximately 2750° F. when poured onto the fabric disposed at an angle of about 70° from the horizontal at a distance approximately 12 inches from the source of the molten iron.

4. The fabric of claim 3 in which the fabric covering includes fibers selected from a group consisting of aramid fibers, phenolic fibers, flame retardant cellulosic fibers, polybenzimidazole fibers, partially oxidized PAN fibers and fully oxidized PAN fibers.

5. A high temperature resistant textile fabric consisting essentially of yarns having a core of continuous fiberglass filament fibers, substantially axially oriented, enclosed within a fiber cover consisting of modacrylic fibers with at least one fiber selected from the group consisting of aramid fibers, phenolic fibers, flame retardant cellulosic fibers, polybenzimidazole fibers, partially oxidized PAN fibers and fully oxidized PAN fibers.

6. A high temperature, thermal shock resistant fabric that resists a molten metal splash measured by pouring two pounds of iron at a temperature of approximately 2750° F. onto the fabric disposed at an angle of about 70° from the horizontal over a distance of approximately 12 inches, said fabric consisting essentially of yarns having a continuous filament fiberglass central core substantially axially oriented and a fiber cover consisting of modacrylic fibers with at least one fiber selected from the group consisting of aramid fibers, phenolic fibers, flame retardant cellulosic fibers, polybenzimidazole fibers, partially oxidized PAN fibers and fully oxidized PAN fibers individually wrapped around the core transverse to the axis.

* * * * *